US010933897B2

(12) United States Patent
Kutschera et al.

(10) Patent No.: US 10,933,897 B2
(45) Date of Patent: Mar. 2, 2021

(54) METHOD AND ARRANGEMENT FOR SECURING A RAILROAD CROSSING

(71) Applicant: SIEMENS MOBILITY GMBH, Munich (DE)

(72) Inventors: Christoph Kutschera, Bad Harzburg (DE); Jens-Harro Oechsner, Denkte ot Neindorf (DE); Thomas Schmidt, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 155 days.

(21) Appl. No.: 16/313,552

(22) PCT Filed: Jun. 1, 2017

(86) PCT No.: PCT/EP2017/063264
§ 371 (c)(1),
(2) Date: Dec. 27, 2018

(87) PCT Pub. No.: WO2018/001674
PCT Pub. Date: Jan. 4, 2018

(65) Prior Publication Data

US 2019/0248395 A1 Aug. 15, 2019

(30) Foreign Application Priority Data

Jun. 27, 2016 (DE) ..... 102016211482.4

(51) Int. Cl.
*B61L 27/00* (2006.01)
*B61L 25/02* (2006.01)
(Continued)

(52) U.S. Cl.
CPC ..... *B61L 27/0038* (2013.01); *B61L 25/021* (2013.01); *B61L 27/0077* (2013.01);
(Continued)

(58) Field of Classification Search
CPC ..... B61L 27/0038; B61L 25/021; B61L 27/0077; B61L 29/22; B61L 29/32; B61L 2027/0044
(Continued)

(56) References Cited

U.S. PATENT DOCUMENTS 9,296,401 B1 * 3/2016 Palmer ..... B61L 25/026
9,493,176 B2 11/2016 Busse et al.
2014/0367526 A1 12/2014 Steffen, II et al.

FOREIGN PATENT DOCUMENTS

DE 19529374 A1 2/1997
DE 10227046 C1 7/2003
(Continued)

*Primary Examiner* — Gertrude Arthur Jeanglaude
(74) *Attorney, Agent, or Firm* — Laurence Greenberg Werner Stemer; Ralph Locher

(57) ABSTRACT

A method secures a railroad crossing which allows a timely securing of the railroad crossing, and is particularly efficient and reliable. The method proceeds in such a way that sensor data relating to a rail-borne vehicle approaching the railroad crossing are detected by a track-side sensor device. The sensor data contains at least the current speed of the rail-borne vehicle. The detected sensor data are transmitted by the track-side sensor device to a stationary control device. A switch-on time is determined by the stationary control device taking into account the transmitted sensor data and route data. Upon reaching the switch-on time, the securing of the railroad crossing is initiated by the stationary control device. After the railroad crossing has been successfully secured, a travel permission that extends beyond the railroad crossing is determined by a control device of a train control system, and is transmitted to the rail-borne vehicle.

16 Claims, 3 Drawing Sheets

(51) Int. Cl.
*B61L 29/22* (2006.01)
*B61L 29/32* (2006.01)

(52) U.S. Cl.
CPC ..... *B61L 29/22* (2013.01); *B61L 29/32* (2013.01); *B61L 2027/0044* (2013.01)

(58) Field of Classification Search
USPC ..... 701/19
See application file for complete search history.

(56) References Cited

FOREIGN PATENT DOCUMENTS

| | | | | | |
|---|---|---|---|---|---|
| DE | 102007022837 | A1 | * | 11/2008 | ..... B61L 29/22 |
| DE | 102007022837 | A1 | | 11/2008 | |
| DE | 102011079186 | A1 | * | 1/2013 | ..... B61L 29/284 |
| DE | 102011079186 | A1 | | 1/2013 | |
| JP | H0357769 | A | | 3/1991 | |
| ZA | 366724 | B | | 2/1997 | |

* cited by examiner

METHOD AND ARRANGEMENT FOR SECURING A RAILROAD CROSSING

BACKGROUND OF THE INVENTION

Field of the Invention

The optimization of closing times of railroad crossings during the operation of rail-borne vehicles, which are, for example, rail vehicles, track-guided vehicles with rubber tires or magnetic levitation trains, are of great importance in practice. Therefore, in the event that the route or the travel path of the rail-borne vehicles crosses other traffic routes, in particular roads, there is firstly a requirement that the corresponding crossing regions are reliably secured by means of railroad crossings. In particular, it is to be ensured that the railroad crossing is secured in good time before the arrival of the respective rail-borne vehicle and in the event of problems in securing the railroad crossing, that the respective rail-borne vehicle can still be brought to a standstill before the railroad crossing. Secondly, the impacts on the crossing traffic, in other words, for example the road traffic, should be kept to a minimum in such a way that the railroad crossing is not secured any longer than necessary. A corresponding securing of the railroad crossing can be effected, for example, by means of a barrier or a plurality of barriers. Furthermore, it is also possible, for example, for the railroad crossing to be secured only by appropriate signaling which indicates a driving prohibition. Such signaling can be, for example, a light signal. Further devices and methods for securing railroad crossings, which can optionally also be combined with one another, are also known, moreover. Therefore, for example, it is possible that a railroad crossing is secured by means of barriers and at the same time, or even in particular before the barriers are lowered, approaching traffic is warned by an appropriate light signal and/or a warning sound.

SUMMARY OF THE INVENTION

The present invention is based on the object of disclosing a method for securing a railroad crossing, which allows timely securing of the respective railroad crossing and at the same time is particularly efficient and reliable.

This object is inventively achieved by a method for securing a railroad crossing, wherein sensor data relating to a rail-borne vehicle approaching the railroad crossing is detected by a track-side sensor device, said sensor data comprising at least the current speed of the rail-borne vehicle, the detected sensor data is transmitted by the track-side sensor device to a stationary control device, a switch-on time is determined by the stationary control device taking into account the transmitted sensor data and track data, upon reaching the switch-on time, securing of the railroad crossing is initiated by the stationary control device, and after the railroad crossing has been successfully secured, a travel permission that extends beyond the railroad crossing is determined by a control device of a train control system and is transmitted to the rail-borne vehicle to replace a previous travel permission that expired prior to reaching the railroad crossing.

According to the first step of the inventive method, sensor data relating to a rail-borne vehicle approaching the railroad crossing is detected by a track-side sensor device, said sensor data comprising at least the current speed of the rail-borne vehicle. The track-side sensor device used for this purpose can in principle be any sensor device known per se. This includes, for example, cameras or light barriers and other systems known per se for determining the speed of rail-borne vehicles. The track-side sensor device can preferably be designed as a two-channel wheel sensor or axle counter. This is advantageous since the corresponding sensor devices are widely used, highly reliable sensor devices in the field of train signal technology. Irrespective of the type of track-side sensor device used, by detecting the rail-borne vehicle, the location thereof at the instant of detection is also identified, and this generally corresponds to the location of the track-side sensor device.

According to the second step of the inventive method, the detected sensor data is transmitted by the track-side sensor device to a stationary control device. The term "stationary" indicates that the relevant control device is arranged outside the rail-borne vehicle at a fixed location. The stationary control device can in this case be located track side, in other words in the region or in the vicinity of a route of the rail-borne vehicle, or can also be arranged at any distance from the respective route. The transmission of the sensor data by the rail-borne vehicle to the stationary control device can in principle be carried out in any manner known per se. The sensor data is preferably transmitted wirelessly by the track-side sensor device to the stationary control device, in other words, for example in a radio-based manner, at least on a part of the communication path.

According to the third step of the inventive method, a switch-on time is determined by the stationary control device by taking into account the transmitted sensor data and track data. In this case, the track data comprises at least one parameter relating to a route of the rail-borne vehicle. As a rule, the relevant, at least one parameter relates to a region of the route between the track-side sensor device and the railroad crossing. However, there is also the possibility that the track data relates entirely or partially to a region of the route of the rail-borne vehicle located behind the railroad crossing, viewed in the direction of travel direction, if this results in effects on the driving behavior of the rail-borne vehicle in a region before the railroad crossing.

According to the fourth feature of the inventive method, upon reaching the switch-on time, securing of the railroad crossing is initiated by the stationary control device. This means that the stationary control device directly or indirectly acts on at least one component provided for securing the railroad crossing in such a way that the component initiates or carries out securing of the railroad crossing. Depending on the type of the means used to secure the railroad crossing, corresponding securing can be provided, for example, by switching on one or more signal lamp(s), closing railway crossing barriers or the initiation of another action for securing the railroad crossing.

According to the last step of the inventive method, after the railroad crossing has been successfully secured, a travel permission that extends beyond the railroad crossing is determined by a control device of a train control system and is transmitted to the rail-borne vehicle to replace a previous travel permission that expired prior to reaching the railroad crossing. In this way, it is therefore possible for the stationary control device to act on the rail-borne vehicle in the event of confirmed securing of the railroad crossing in such a way that a travel permission is transmitted to it which extends beyond the railroad crossing. A corresponding travel permission is also referred to as a "movement authority" and, in the specific case, has the consequence that, in accordance with the previous travel permission, the rail-borne vehicle does not come to a standstill before the railroad crossing, but can pass the railroad crossing without stopping and optionally also without reducing its speed.

The inventive method is characterized in that it incorporates the control device of the train control system beyond conventional system boundaries into the method for securing the railroad crossing. In this way it is advantageously possible to provide feedback to the rail-borne vehicle by transmitting a corresponding revalued travel permission, with a communication channel which is provided in any case for communication between the rail-borne vehicle and the control device of the train control system advantageously being used for the transmission of the travel permission.

The inventive method is furthermore particularly efficient in that it uses sensor data relating to the respective rail-borne vehicle approaching the railroad crossing as well as track data for determining the switch-on time. The inventive method thereby enables timely securing of the railroad crossing in a particularly reliable manner, wherein a closing time of the railroad crossing can be achieved depending on respective conditions, which time is largely constant irrespective of the speed of the respective rail-borne vehicle.

In the context of the inventive method, the switch-on time can be determined or specified absolutely, in other words, for example, by specifying a clock time which is preferably at least accurate to the second, or else indirectly.

According to a particularly preferred development of the inventive method, a switch-on time is determined in the form of a switch-on delay. In this case, the switch-on delay is a period after the expiry of which securing of the railroad crossing is initiated. Determination of a switch-on time in the form of a switch-on delay is advantageous since it enables a particularly simple implementation of the method. Therefore, the specification of a switch-on delay offers the advantage that this specification is independent of an absolute time and allows a direct comparability and plausibility check independently of the respective time of day.

The inventive method can preferably also be designed such that the track data comprises at least one of the following parameters: distance between the track-side sensor device and the railroad crossing, permissible track speed, position of a station, position of a speed restriction section, track topology. This embodiment of the inventive method is advantageous in that said parameters are those which have a direct influence on how long the approach time is, in other words the time which the rail-borne vehicle requires in order to pass from the track-side sensor device to the railroad crossing (at the earliest). In the sense of a best possible accuracy when determining the switch-on time, preferably all available and relevant parameters are taken into account as track data. As already mentioned above, the track data as a rule relates to a route between the track-side sensor device and the railroad crossing. However, the possibility also exists, for example, with respect to the position of a station or a speed restriction section, that a section or region of the route located behind the railroad crossing, when viewed in the direction of travel, has effects on the driving behavior of the rail-borne vehicle in the region before the railroad crossing.

Preferably, the inventive method can also be further developed in such a way that when determining the switch-on time for the respective rail-borne vehicle, specific vehicle data, in particular a vehicle type can be taken into account. Consideration of corresponding vehicle data offers the advantage that it optionally allows the accuracy of determination of the switch-on time to be improved further and therefore, in particular, allows unnecessarily early switching-on or securing of the railroad crossing to be avoided. In this case, for example with the aid of a vehicle type, for example in the form of a differentiation between passenger trains and goods trains, vehicle type-specific properties, such as, for example permissible maximum speed, acceleration capacity or braking capacity, can be taken into account.

In principle, the stationary control device can be any component of a rail-borne traffic system in which or by which the rail-borne vehicle is operated. Therefore, depending on the respective conditions and circumstances, a different implementation of the stationary control device can be expedient.

According to a further particularly preferred embodiment of the inventive method, a local control component of the railroad crossing is used as the stationary control device. A corresponding local control component can be, for example, a railroad crossing controller of the relevant railroad crossing. This offers the advantage that corresponding railroad crossing controllers are frequently already connected, in terms of communication or signaling, for the purpose of control and monitoring to a signal box, and therefore communication with the signal box and optionally further components connected to the signal box is possible. The use of the local control component of the railroad crossing as a stationary control device also offers the advantage that a largely decentralized solution is achieved as a result. This leads, in particular, to the fact that in the event of a disruption or a failure of the stationary control device, preferably only the relevant railroad crossing is affected hereby. It should be pointed out that the local control component can also be an independent controller of the railroad crossing. In this case, however, the controller is connected in terms of communication to the conventional railroad crossing controller in order to be able to initiate securing of the railroad crossing thereby.

According to another particularly preferred embodiment, the inventive method is designed in such a way that a signal box is used as the stationary control device and securing of the railroad crossing is initiated as a result of the fact that a securing signal is transmitted by the signal box to a local control component of the railroad crossing and securing of the railroad crossing is triggered by the local control component upon receipt of the securing signal. This embodiment of the inventive method offers the advantage that signal boxes are, as a rule, already connected in terms of communication or signaling to local control components of railroad crossings anyway and are preferably designed to control corresponding external elements in a manner which is preferably reliable in terms of signaling. Changes to the respective railroad crossings or their local control components are advantageously avoided by way of a corresponding central implementation of the stationary control device as a signal box. This can result in particular in savings or advantages in terms of complexity and costs for implementing the method.

According to a further preferred development of the inventive method, the method is designed in such a way that the control device of the train control system is used as the stationary control device and securing of the railroad crossing is initiated by the fact that a request for securing the railroad crossing is transmitted by the control device of the train control system to a signal box which is connected to the railroad crossing in terms of communication, a securing signal is then transmitted by the signal box to a local control component of the railroad crossing, and securing of the railroad crossing is triggered by the local control component upon receipt of the securing signal. Use of the control device of the train control system as a stationary control device offers the advantage that it frequently has a communication link to the rail-borne vehicle but, on the other hand, is also connected in terms of communication to a local control component of the railroad crossing for example by means of a signal box. Depending on the respective situation, this can lead in particular to no additional, new communication links having to be provided in order to implement the method, so implementation of the method is simplified and costs are saved.

According to a particularly preferred embodiment of the two aforementioned preferred developments of the inventive method, after the railroad crossing has been successfully secured, an acknowledgement signal is transmitted by the local control component to the stationary control device. In this way it is therefore possible for the case where the stationary control device itself is not arranged in the immediate vicinity of the railroad crossing or is implemented as a local control component thereof, to give corresponding feedback to the stationary control device, after the railroad crossing has been successfully secured by means of the acknowledgement signal. This consequently allows the stationary control device to determine the travel permission that extends beyond the railroad crossing, or to pass on feedback about successful securing of the railroad crossing to the control device of the train control system.

Preferably, the inventive method can also be designed in such a way that the switch-on time is determined by the stationary control device by also taking into account a speed curve possible for the rail-borne vehicle further approaching the railroad crossing. In this case, for example, an acceleration of the rail-borne vehicle measured by the track-side sensor device, or a known acceleration capacity of the rail-borne vehicle can be taken into account. This offers the advantage that, in contrast to an alternative procedure, in which a journey at a constant speed of the rail-borne vehicle is assumed, the method takes into account an increase in the speed of the rail-borne vehicle with respect to timely securing of the railroad crossing.

According to another particularly preferred development of the inventive method, the switch-on time is determined by the stationary control device by taking into account a period required for securing the railroad crossing. In this case, the period taken into account preferably comprises all times or delays, which can occur when securing the railroad crossing. This includes, for example, a barrier run time, a pre-lighting/clearing time and/or required communication and activation times. By way of appropriate consideration of the period required for securing the railroad crossing, timely securing of the railroad crossing can advantageously be reliably ensured even under unfavorable circumstances.

The inventive method can preferably also be developed in such a way that a control device of a train control system with continuous communication between the control device and the rail-borne vehicle is used, in particular a control device according to one of the standards ETCS (European Train Control System), CTCS (Chinese Train Control System) or PTC (Positive Train Control). This embodiment of the inventive method is advantageous in that in particular train control systems with continuous communication between the rail-borne vehicles and the control device of the train control system are suitable for implementing the inventive method. This relates in particular therefore to train control systems according to ETCS level 2 or 3, CTCS level 3 or 4 or the American train control system PTC. Owing to the high supported speeds, appropriate modern train control systems frequently do not have any railroad crossings at all. By way of the present invention it is now possible, however, also and precisely in such systems, to ensure reliable and timely securing of railroad crossings and to thereby minimize the closing time of the railroad crossing in the sense of a best possible "constant warning time".

The present invention further relates to an arrangement for securing a railroad crossing.

With regard to the arrangement, the present invention is based on the object of disclosing an arrangement which supports a method for securing a railroad crossing, which allows timely securing of the respective railroad crossing and at the same time is particularly efficient and reliable.

This object is inventively achieved by an arrangement for securing a railroad crossing, having a track-side sensor device for detecting sensor data relating to a rail-borne vehicle approaching the railroad crossing, said sensor data comprising at least the current speed of the rail-borne vehicle, and for transmitting the detected sensor data from the track-side sensor device to a stationary control device, the stationary control device for determining a switch-on time by taking into account the transmitted sensor data and track data and for initiating securing of the railroad crossing when the switch-on time is reached, and having a control device of a train control system for determining a travel permission that extends beyond the railroad crossing after the railroad crossing has been successfully secured and for transmitting the determined travel permission to the rail-borne vehicle to replace a previous travel permission that expired prior to reaching the railroad crossing.

The advantages of the inventive arrangement essentially match those of the inventive method, so reference is made in this regard to the corresponding preceding statements. The same applies in respect of the preferred developments of the inventive arrangement mentioned below in relation to the corresponding respective preferred development of the inventive method, so reference is also made in this regard to the respective preceding remarks.

According to a particularly preferred embodiment of the inventive arrangement, the stationary control device is a local control component of the railroad crossing.

As an alternative to this, the inventive arrangement can advantageously also be designed in such a way that the stationary control device is a signal box.

According to a further particularly preferred embodiment of the inventive arrangement, the stationary control device is the control device of the train control system.

According to a further particularly preferred development of the inventive arrangement, said arrangement is designed to carry out the method according to one of the aforementioned preferred developments of the inventive method.

BRIEF DESCRIPTION OF THE SEVERAL VIEWS OF THE DRAWING

The invention will be illustrated in more detail below with reference to exemplary embodiments. In the drawings.

DESCRIPTION OF THE INVENTION

Figure 1:
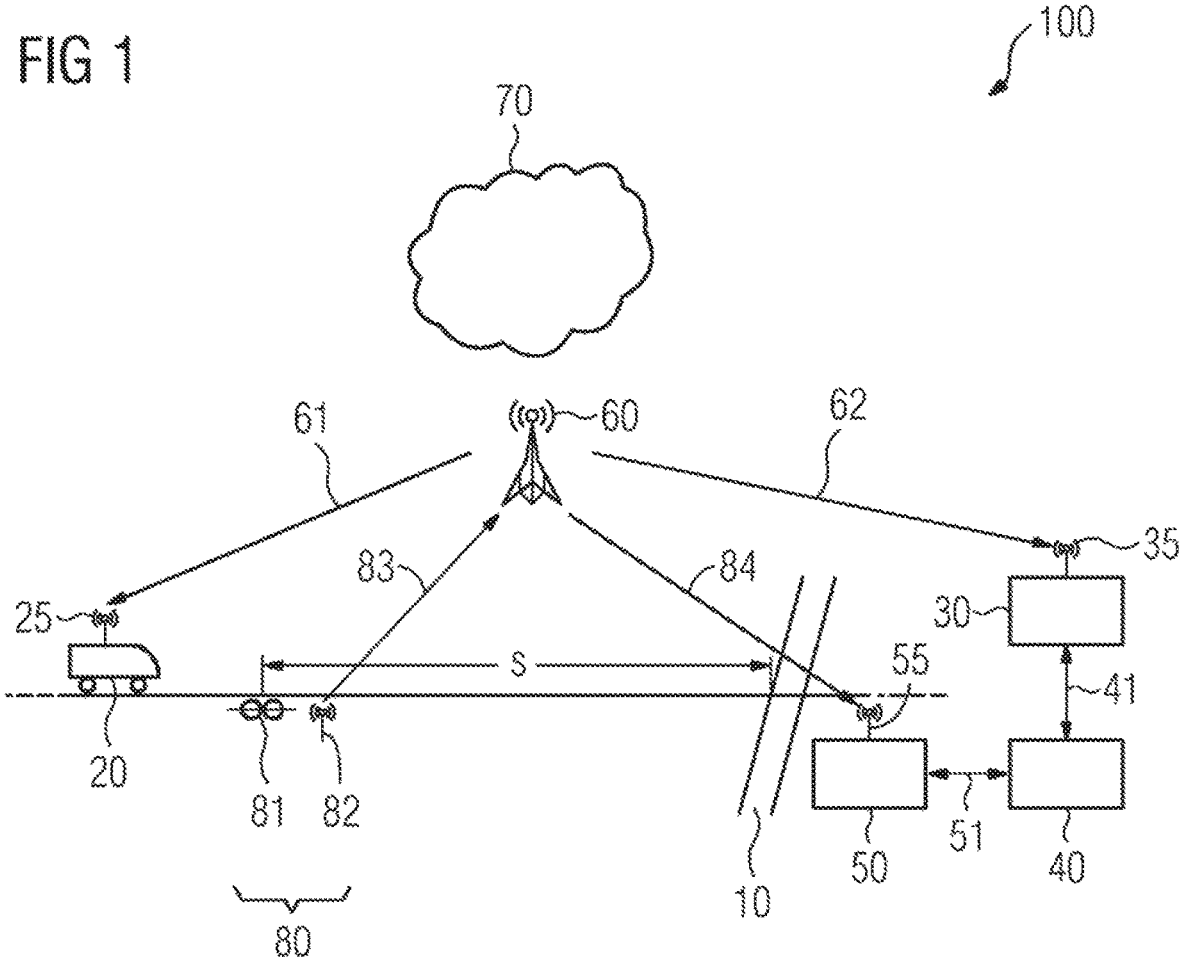
FIG. 1 shows a first exemplary embodiment of the inventive arrangement in a first schematic sketch for the purpose of illustrating a first exemplary embodiment of the inventive method.

In the figures, identical components or components with the same effect are identified by identical reference numerals for reasons of clarity.

FIG. 1 shows a first exemplary embodiment of the inventive arrangement 100 in a first schematic sketch for the purpose of illustrating a first exemplary embodiment of the inventive method.

In detail, a railroad crossing 10 is indicated in this case, which a rail-borne vehicle 20 approaches coming from the left. A control device 30 of a train control system can also be seen in the representation of FIG. 1. In the context of the exemplary embodiment described, it should be assumed that the control device 30 is a control center in the form of a radio block center (RBC) of a train control system according to the standard ETCS (European Train Control System) level 2. Furthermore, a signal box 40 and a local control component 50 of the railroad crossing 10 are indicated in the representation of FIG. 1. The signal box 40 is connected in terms of communication firstly by a bidirectional communication link 41 to the control device 30. Secondly, the signal box 40 is also connected in terms of communication or signaling to the local control component 50 of the railroad crossing 10 by a bidirectional communication link 51.

According to the representation of FIG. 1, there is also a bidirectional communication link 61, 62 between a vehicle-side antenna 25 of the rail-borne vehicle 20 and an antenna 35 of the control device 30 of the train control system. In the exemplary embodiment of FIG. 1 this bidirectional communication link 61, 62, which can also be referred to as a communication channel, is designed as a wireless, mobile communication link and, within the scope of the exemplary embodiment described, is intended to occur via the railway-specific mobile radio network GSM-R (Global System for Mobile Communications—Railway). For this purpose, the indicated mobile radio network identified by the reference numeral 70 has a base station 60, via which bidirectional communication between the rail-borne vehicle 20 and the control device 30 is possible by means of sections of track or partial communication links 61 and 62. To avoid misunderstandings, it should be pointed out at this point that the corresponding communication link could of course also be at least partially wired. It is therefore conceivable, for example, for the control device 30 to be connected in a wired manner, in other words for example via a copper or glass-fiber cable, to the mobile radio network 70 or to the base station 60 thereof.

In addition to the components already mentioned, a track-side sensor device 80 can be seen in FIG. 1, which, within the scope of the exemplary embodiment illustrated, is a radio-operated approach indicator which is arranged at a distance s in front of the railroad crossing 10. The track-side sensor device 80 comprises a wheel sensor 81 and a radio module 82, via which the track-side sensor device 80 can establish by way of the mobile radio network 70 or the base station 60 thereof (or another base station of the mobile radio network 70) a communication link 83, 84 with the local control component 50 and can transmit data thereto. For this purpose, the local control component 50 of the railroad crossing 10 has an antenna 55. As an alternative to this, a wired communication link between the local control component 50 and the mobile radio network 70 or between the local control component 50 of the railroad crossing 10 and the track-side sensor device 80 would in principle also be conceivable. In the exemplary embodiment of FIG. 1, the communication link 83, 84 is designed as a unidirectional connection; as an alternative to this, it could, of course, also be a bidirectional communication link.

The arrangement 100 shown in FIG. 1 can now be used, for example, for securing the railroad crossing 10 in such a way that sensor data relating to the rail-borne vehicle 20 approaching the railroad crossing 10 is detected by the track-side sensor device 80 when the rail-borne vehicle 20 moves past, said sensor data comprising at least the current speed of the rail-borne vehicle 20. In addition, the sensor data could also comprise, for example, information relating to a possible acceleration of the rail-borne vehicle in the detection region, to the number of axles of the rail-borne vehicle 20 or also to the position of the rail-borne vehicle 20 on the route. The latter results implicitly from the fact that at the time of its detection by the sensor device 80, the rail-borne vehicle 20 stops at the position or at the location of the sensor device 80 or of the wheel sensor 81 thereof.

In the next step, the detected sensor data can now be transmitted by the track-side sensor device 80 by means of the radio module or the antenna 82 via the communication link or partial communication links 83, 84 and the antenna 55 to the local control component 50 of the railroad crossing 10. The local control component 50 of the railroad crossing 10, which can also be referred to as a stationary control device, can be designed, for example, either as a component of a railroad crossing control or else as a separate component. Independently of this, the local control component 50 of the railroad crossing 10 is "local", in that it is associated with the railroad crossing 10 and is arranged in the region of the railroad crossing 10.

A switch-on time is determined by the stationary control device in the form of the local control component 50 of the railroad crossing 10 by taking into account the transmitted sensor data and track data. The track data in this case preferably comprises, in particular, the distance between the track-side sensor device 80 and the railroad crossing 10, in other words the length of the approach section of track. Furthermore, the track data can preferably also comprise further parameters, such as, for example a permissible track speed, a station which is arranged between the track-side sensor device and the railroad crossing or, viewed in the direction of travel, closely behind the railroad crossing, a speed restriction section arranged between the track-side sensor device and the railroad crossing (or closely behind the railroad crossing), or also, generally, the track topology, for instance in the form of information relating to the inclination of the route, in other words, for example to sections with a slope or gradient.

The specification of the switch-on time can in principle be made in any format. What is essential here is only that an instant lying in the future is uniquely determined hereby. The switch-on time can therefore be specified, for example, as a time of day. However, the switch-on time is preferably determined in the form of a switch-on delay. In this case, the switch-on delay specifies after which period (relative to the detection of the rail-borne vehicle 20 by the track-side sensor device 80) the switch-on or securing of the railroad crossing 10 is to be initiated. Consequently, a result of determination of the switch-on time by taking into account the transmitted sensor data and the track data can consist, for example, in that a switch-on delay of 28 seconds is determined, in other words that securing of the railroad crossing is to be initiated after the expiry of 28 seconds. When determining the switch-on time, preferably the period required for actual securing of the railroad crossing 10 is taken into account.

According to the above statements, when the switch-on time is reached by the stationary control device in the form of the local control component 50 of the railroad crossing 10, securing of the railroad crossing 10 is initiated. After the railroad crossing 10 has been successfully secured, which the local control component 50 itself detects or has communicated from a railroad crossing control of the railroad crossing 10, the local control component transmits an acknowledgement signal via the communication link 51 to the signal box 40 which passes it to the control device 30 of the train control system via the communication link 41. The control device 30 of the train control system therefore provides feedback to the effect that the railroad crossing 10 has been successfully secured. This allows the control device 30 of the train control system to determine a travel permission for the rail-borne vehicle 20 that extends beyond the railroad crossing 10 and to transmit this to the rail-borne vehicle 20 via the communication link 62, 61 to replace a previous travel permission that expired prior to reaching the railroad crossing 10. The result of this is that the rail-borne vehicle 20, based on the received travel permission, which is also referred to as a "movement authority", can pass through the railroad crossing 10 without stopping and, optionally, without a reduction in speed, and is therefore not adversely affected in its travel mode by the railroad crossing 10. Conversely, the method described offers the advantage in relation to the railroad crossing 10 or to participants in the traffic crossing the railroad crossing 10, that as a result of the situation-related determination of the switch-on time, unnecessarily long securing of the railroad crossing 10 is avoided and therefore the corresponding interference is kept as low as possible.

In particular, a largely identical closing time of the railroad crossing, in other words a "constant warning time", can hereby be achieved for rail-borne vehicles of different types and different operational situations.

When determining the switch-on time, specific vehicle data can advantageously also be taken into account for the respective rail-borne vehicle 20. Such vehicle data can in particular be a vehicle type, in other words for example a train type. A corresponding differentiation, for example between passenger trains and goods trains, makes it possible to carry out a further optimization of the determination of the switch-on time on the basis of differences associated therewith, for instance in relation to the maximum speed, acceleration capacity or braking capacity.

Furthermore, the switch-on time can be determined by the stationary control device in the form of the local control component 50 of the railroad crossing 10 with additional consideration of a speed curve which is possible for a further approach of the rail-borne vehicle 20 to the railroad crossing 10. For this purpose, different predictions can be produced or determined within the scope of the method used, with which, for example, possible changes in the speed within the approach section of track can be taken into account. Specifically, the method can take into account, for example, the acceleration or the acceleration capacity of the respective rail-borne vehicle 20 in relation to timely securing of the railroad crossing 10.

The period required for securing the railroad crossing 10 is fixed by the respective railroad crossing 10, so, after expiry of this period, a "secured" message can be expected as feedback from the railroad crossing 10 or the railroad crossing controller. If there is no corresponding message or the message cannot be transmitted, for example owing to a fault, then on the basis of the driving permission present in the rail-borne vehicle 20, braking of the rail-borne vehicle 20 is, as a rule, initiated at the latest possible instant, with the latest possible instant or the corresponding location and, optionally, the final speed when reaching the railroad crossing 10 (for example complete stop or walking pace), as such being known or predefined and in the case of ETCS level 2 can be or are stored for example in a speed curve of the rail-borne vehicle 20.

According to the above statements, the intermittent detection of the sensor data by the sensor device 80 in combination with the communication between the control device 30 of the train control system and the rail-borne vehicle 20 therefore allows the closing time of the railroad crossing 10 to be optimized in the sense of a "constant warning time".

Figure 2:
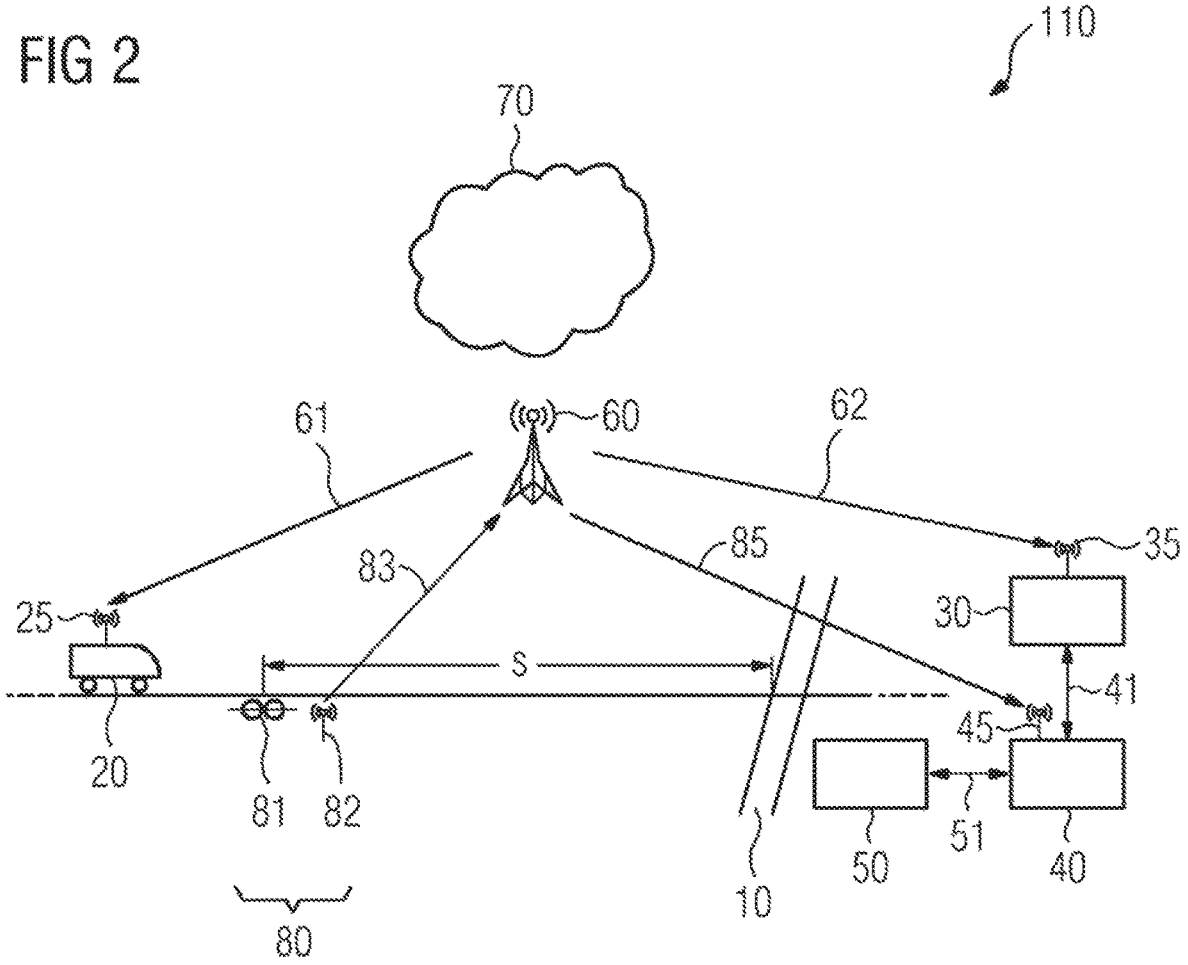
FIG. 2 shows a second exemplary embodiment of the inventive arrangement in a second schematic sketch for the purpose of illustrating a second exemplary embodiment of the inventive method.

FIG. 2 shows a second exemplary embodiment of the inventive arrangement 110 in a second schematic sketch for the purpose of illustrating a second exemplary embodiment of the inventive method.

The representation of FIG. 2 corresponds essentially to that of FIG. 1. In contrast to FIG. 1, the sensor data in the exemplary embodiment of FIG. 2 is, however, transmitted by the sensor device 80 via a communication link 83, 85 to the signal box 40 or to a computer of the latter on the signal box side. This is indicated in FIG. 2 in that the signal box 40 has an antenna 45 or a corresponding radio module.

With regard to the sequence of the method, essentially the above statements in connection with FIG. 1 apply accordingly. However, in the exemplary embodiment of FIG. 2, in which the signal box 40 is used as a stationary control device, securing of the railroad crossing is initiated in that a securing signal is transmitted by the signal box 40 to the local control component 50 of the railroad crossing 10 and securing of the railroad crossing 10 is triggered by the local control component 50 upon receipt of the securing signal. In a corresponding manner, after the railroad crossing 10 has been successfully secured, a corresponding acknowledgement signal is transmitted by the local control component 50 via the communication link 51 to the signal box 40 and is passed by the signal box via the communication link 41 to the control device 30 of the train control system in a manner analogous to the exemplary embodiment of FIG. 1.

The exemplary embodiment of the inventive arrangement 110 in FIG. 2 is particularly advantageous in that additional components or changes in the region of the railroad crossing 10 or of its local control component 50 are advantageously avoided.

Figure 3:
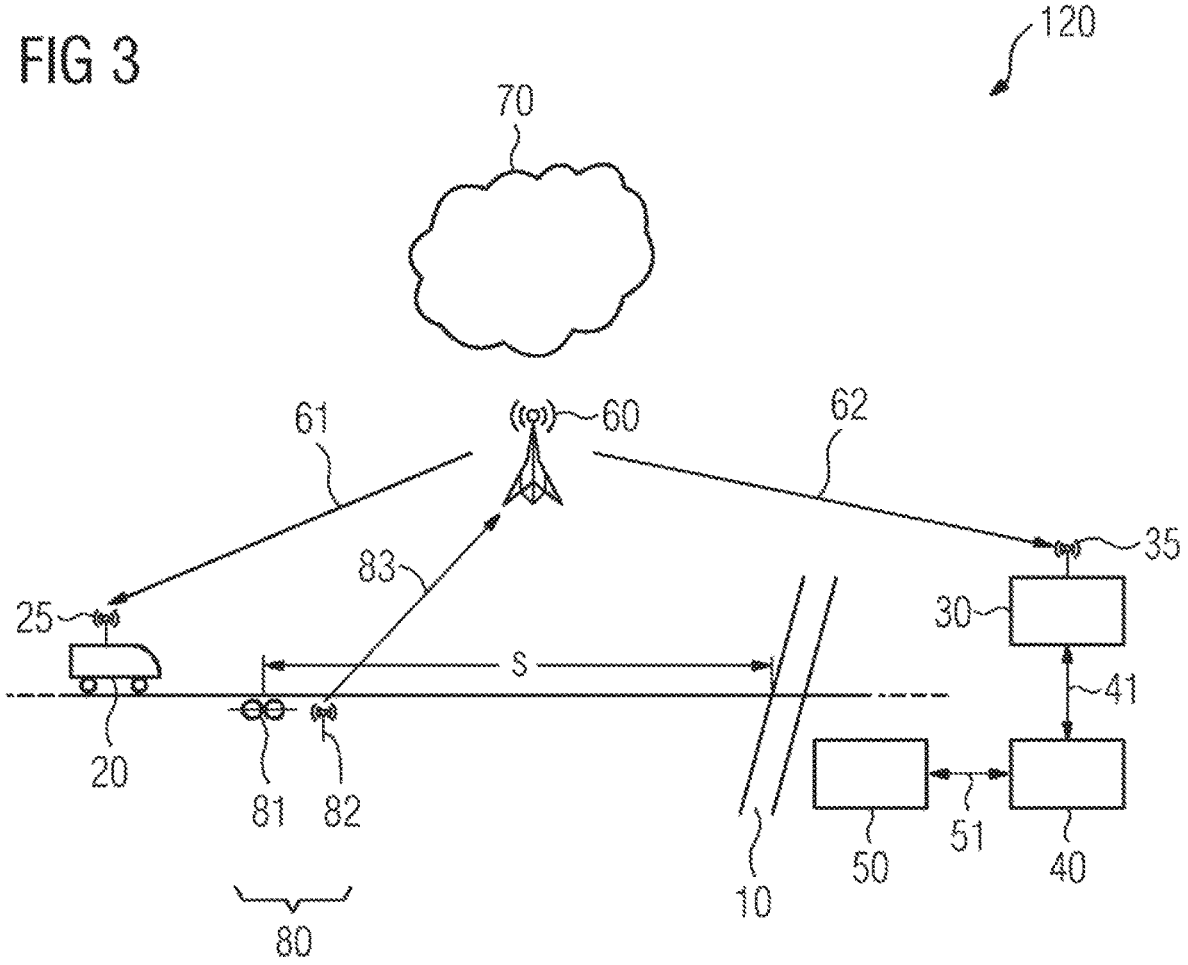
FIG. 3 shows a third exemplary embodiment of the inventive arrangement in a third schematic sketch for the purpose of illustrating a third exemplary embodiment of the inventive method.

FIG. 3 shows a third exemplary embodiment of the inventive arrangement 120 in a third schematic sketch for the purpose of illustrating a third exemplary embodiment of the inventive method.

The representation of FIG. 3 in turn essentially corresponds to that of FIGS. 1 and 2. However, in the exemplary embodiment of FIG. 3, the control device 30 of the train control system is used as a stationary control device and therefore for determining the switch-on time. For this purpose, the control device 30 receives from the sensor device 80 via the communication link 83, 62 the sensor data and taking into account the received sensor data and track data, determines the switch-on time. In this case, securing of the railroad crossing 10 is initiated in such a way that a request for securing the railroad crossing 10 is transmitted by the control device 30 of the train control system to the signal box 40 which is connected in terms of communication to the railroad crossing 10. A securing signal is then transmitted by the signal box 40 to the local control component 50 of the railroad crossing 10 and securing of the railroad crossing 10 is triggered by the local control component 50 upon receipt of the securing signal. After the railroad crossing 10 has been successfully secured, an acknowledgement signal is transmitted by the local control component 50 via the signal box 40 to the stationary control device in the form of the control device 30 of the train control system.

The embodiment of FIG. 3 is expedient or advantageous in particular for such cases in which the control device 30 of the train control system is already connected via a communication connection, for instance in the form of a radio link, which can be used for communication with the track-side sensor device.

According to the above statements in connection with the described exemplary embodiments of the inventive method and the inventive arrangement, these have, in particular, the advantage that they allow the railroad crossing 10 to be secured in a particularly efficient and reliable manner. In this case, an unnecessarily long closing time of the railroad crossing 10 is advantageously avoided and a largely uniform closing time is achieved. At the same time, possible risks due to securing of the railroad crossing 10 that is too late or a fault when carrying out securing, in particular due to revaluing of the travel permission of the rail-borne vehicle 20 only after successful securing of the railroad crossing 10, are reliably avoided. The described procedure, in particular in connection with the train control systems ETCS levels 2 and 3, CTCS levels 3 and 4 and PTC, is advantageous owing to the possibility of a corresponding continuous communication between the control device 30 of the train control system and the rail-borne vehicle 20.

The invention claimed is:

1. A method for securing a railroad crossing, which comprises the steps of:

detecting sensor data relating to a rail-borne vehicle approaching the railroad crossing by a track-side sensor, the sensor data including at least a current speed of the rail-borne vehicle;

transmitting the sensor data detected by the track-side sensor to a stationary controller;

determining a switch-on time by the stationary controller taking into account the sensor data transmitted and track data;

upon reaching the switch-on time, securing of the railroad crossing is initiated by the stationary controller; and after the railroad crossing has been successfully secured, determining a travel permission that extends beyond the railroad crossing by a controller of a train control system and transmitting the travel permission to the rail-borne vehicle to replace a previous travel permission that expired prior to reaching the railroad crossing.

2. The method according to claim 1, which further comprises determining the switch-on time in a form of a switch-on delay.

3. The method according to claim 1, wherein the track data contains at least one of the following parameters:

a distance between the track-side sensor and the railroad crossing;

a permissible track speed;

a position of a station;

a position of a speed restriction section; and a track topology.

4. The method according to claim 1, wherein when determining the switch-on time for the rail-borne vehicle, specific vehicle data is taken into account.

5. The method according to claim 1, which further comprises using a local controller of the railroad crossing as the stationary controller.

6. The method according to claim 1, wherein a signal box is used as the stationary controller, and securing of the railroad crossing is initiated by a fact that:

a securing signal is transmitted by the signal box to a local controller of the railroad crossing; and a securing of the railroad crossing is triggered by the local controller upon receipt of the securing signal.

7. The method according to claim 1, wherein the controller of the train control system is used as the stationary controller and securing of the railroad crossing is initiated by:

transmitting a request for securing the railroad crossing by the controller of the train control system to a signal box which is connected in terms of communication to the railroad crossing;

transmitting a securing signal by the signal box to a local controller of the railroad crossing; and triggering the securing of the railroad crossing by the local controller upon receipt of the securing signal.

8. The method according to claim 6, which further comprises transmitting, after the railroad crossing has been successfully secured, an acknowledgement signal by the local controller to the stationary controller.

9. The method according to claim 1, which further comprises determining the switch-on time by the stationary controller by further taking into account a speed curve possible for the rail-borne vehicle further approaching the railroad crossing.

10. The method according to claim 1, which further comprises determining the switch-on time by the stationary controller by taking into account a period required for securing the railroad crossing.

11. The method according to claim 1, wherein the controller of the train control system performs continuous communication between the controller and the rail-borne vehicle according to one of a European Train Control System standard, a Chinese Train Control System standard or a Positive Train Control standard.

12. The method according to claim 4, wherein the specific vehicle data includes a vehicle type.

13. A configuration for securing a railroad crossing, the configuration comprising:

a stationary controller;

a track-side sensor configured to:

detect sensor data relating to a rail-borne vehicle approaching the railroad crossing, said sensor data including at least a current speed of the rail-borne vehicle; and transmit the sensor data detected from said track-side sensor to said stationary controller;

said stationary controller configured to:

determine a switch-on time by taking into account the sensor data transmitted and track data; and initiate securing of the railroad crossing when the switch-on time is reached;

a controller of a train control system, said controller configured to:

determine a travel permission that extends beyond the railroad crossing after the railroad crossing has been successfully secured; and transmit the travel permission determined to the rail-borne vehicle to replace a previous travel permission that expired prior to reaching the railroad crossing.

14. The configuration according to claim 13, wherein said stationary controller is a local controller of the railroad crossing.

15. The configuration according to claim 13, wherein said stationary controller is a signal box.

16. The configuration according to claim 13, wherein said stationary controller is a controller of a train control system.

* * * * *